US007647651B2

(12) United States Patent
Contant et al.

(10) Patent No.: US 7,647,651 B2
(45) Date of Patent: Jan. 19, 2010

(54) SHOULDER PADS

(75) Inventors: Mathieu Contant, Verdun (CA); Jean-François Laperrière, Prévost (CA); Jean-François Béland, Montreal (CA)

(73) Assignee: Bauer Hockey, Inc., Greenland, NH (US)

( * ) Notice: Subject to any disclaimer, the term of this patent is extended or adjusted under 35 U.S.C. 154(b) by 412 days.

(21) Appl. No.: 11/506,875

(22) Filed: Aug. 21, 2006

(65) Prior Publication Data

US 2007/0050884 A1 Mar. 8, 2007

(30) Foreign Application Priority Data

Sep. 8, 2005 (CA) ..... 2518373

(51) Int. Cl.
*A41D 13/00* (2006.01)

(52) U.S. Cl. ..... 2/459

(58) Field of Classification Search ..... 2/459, 2/44, 45, 69, 94, 267, 115
See application file for complete search history.

(56) References Cited

U.S. PATENT DOCUMENTS 4,467,475 A * 8/1984 Gregory et al. ..... 2/462
7,103,924 B2 * 9/2006 Morrow et al. ..... 2/461

* cited by examiner

*Primary Examiner*—Tejash Patel

(57) ABSTRACT

Shoulder pads for protecting a sports player having a thorax with left and right front regions and left and right rear regions. The shoulder pads comprising first and second left front separate protective panels and first and second right front separate protective panels for covering at least partially the respective left and right front regions of the thorax, the first left front panel at least partially overlapping the second left front panel and the first right front panel at least partially overlapping the second right front panel, the first and second left and right front panels being connected together by a front elastic band allowing movement of the first left and right front panels relative to the respective second left and right front panels between an extended position, wherein there is a first front overlapping between the respective first and second left and right front panels, and a retracted position, wherein there is a second front overlapping between the respective first and second left and right front panels, the second front overlapping being larger than the first front overlapping.

14 Claims, 6 Drawing Sheets

SHOULDER PADS

FIELD OF THE INVENTION

The present invention relates to shoulder pads having overlapping protective panels for covering the upper body of a sports player, in such sports as hockey, football, and lacrosse, for example.

BACKGROUND OF THE INVENTION

Traditional shoulder pads have protective pads that do not necessarily follow the contour of the upper body when the sports player adopts different positions.

There is therefore a need for shoulder pads offering an appropriate level of protection while allowing greater mobility to the sports player.

SUMMARY OF THE INVENTION

As embodied and broadly described herein, the present invention provides shoulder pads for protecting a sports player having a thorax with left and right front regions and left and right rear regions, said shoulder pads comprising first and second left front separate protective panels and first and second right front separate protective panels for covering at least partially the respective left and right front regions of the thorax, said first left front panel at least partially overlapping said second left front panel and said first right front panel at least partially overlapping said second right front panel, said first and second left and right front panels being connected together by a front elastic band allowing movement of said first left and right front panels relative to said respective second left and right front panels between an extended position, wherein there is a first front overlapping between said respective first and second left and right front panels, and a retracted position, wherein there is a second front overlapping between said respective first and second left and right front panels, said second front overlapping being larger than said first front overlapping.

The invention also provides shoulder pads for protecting a sports player having a thorax with left and right front regions and left and right rear regions, said shoulder pads comprising first and second left rear separate protective panels and first and second right rear separate protective panels for covering at least partially the respective left and right rear regions of the thorax, said first left rear panel at least partially overlapping said second left rear panel and said first right rear panel at least partially overlapping said second right rear panel, said first and second left and right rear panels being connected together by a rear elastic band allowing movement of said first left and right rear panels relative to said respective second left and right rear panels between an extended position, wherein there is a first rear overlapping between said respective first and second left and right rear panels, and a retracted position, wherein there is a second rear overlapping between said respective first and second left and right rear panels, said second rear overlapping being larger than said first rear overlapping.

The invention also provides shoulder pads for protecting a hockey player having a thorax with left and right front regions and left and right rear regions, said shoulder pads comprising: (a) first and second left front separate protective panels and first and second right front separate protective panels for covering at least partially the respective left and right front regions of the thorax, said first left front panel at least partially overlapping said second left front panel and said first right front panel at least partially overlapping said second right front panel, said first and second left and right front panels being connected together by a front elastic band allowing movement of said first left and right front panels relative to said respective second left and right front panels between an extended position, wherein there is a first front overlapping between said respective first and second left and right front panels, and a retracted position, wherein there is a second front overlapping between said respective first and second left and right front panels, said second front overlapping being larger than said first front overlapping; and (b) first and second left rear separate protective panels and first and second right rear separate protective panels for at least partially covering the respective left and right rear regions of the thorax, said first left rear panel at least partially overlapping said second left rear panel and said first right rear panel at least partially overlapping said second right rear panel, said first and second left and right rear panels being connected together by a rear elastic band allowing movement of said first left and right rear panels relative to said respective second left and right rear panels between an extended position, wherein there is a first rear overlapping between said respective first and second left and right rear panels, and a retracted position, wherein there is a second rear overlapping between said respective first and second left and right rear panels, said second rear overlapping being larger than said first rear overlapping.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of the embodiments of the present invention is provided herein below, by way of example only, with reference to the accompanying drawings, in which.

Figure 1:
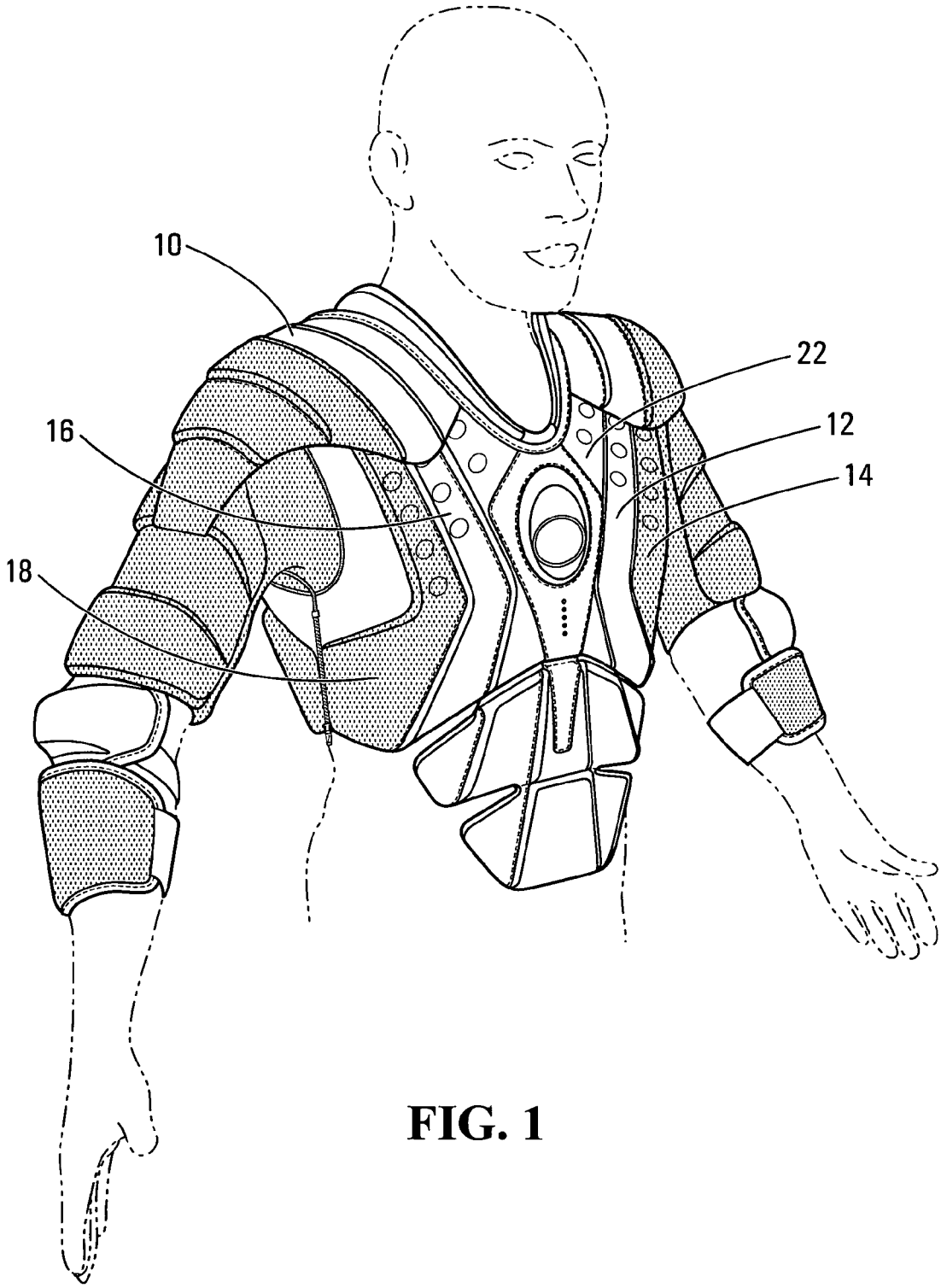
FIG. 1 is a perspective front side view of the shoulder pads constructed in accordance with the invention.
Figure 2:
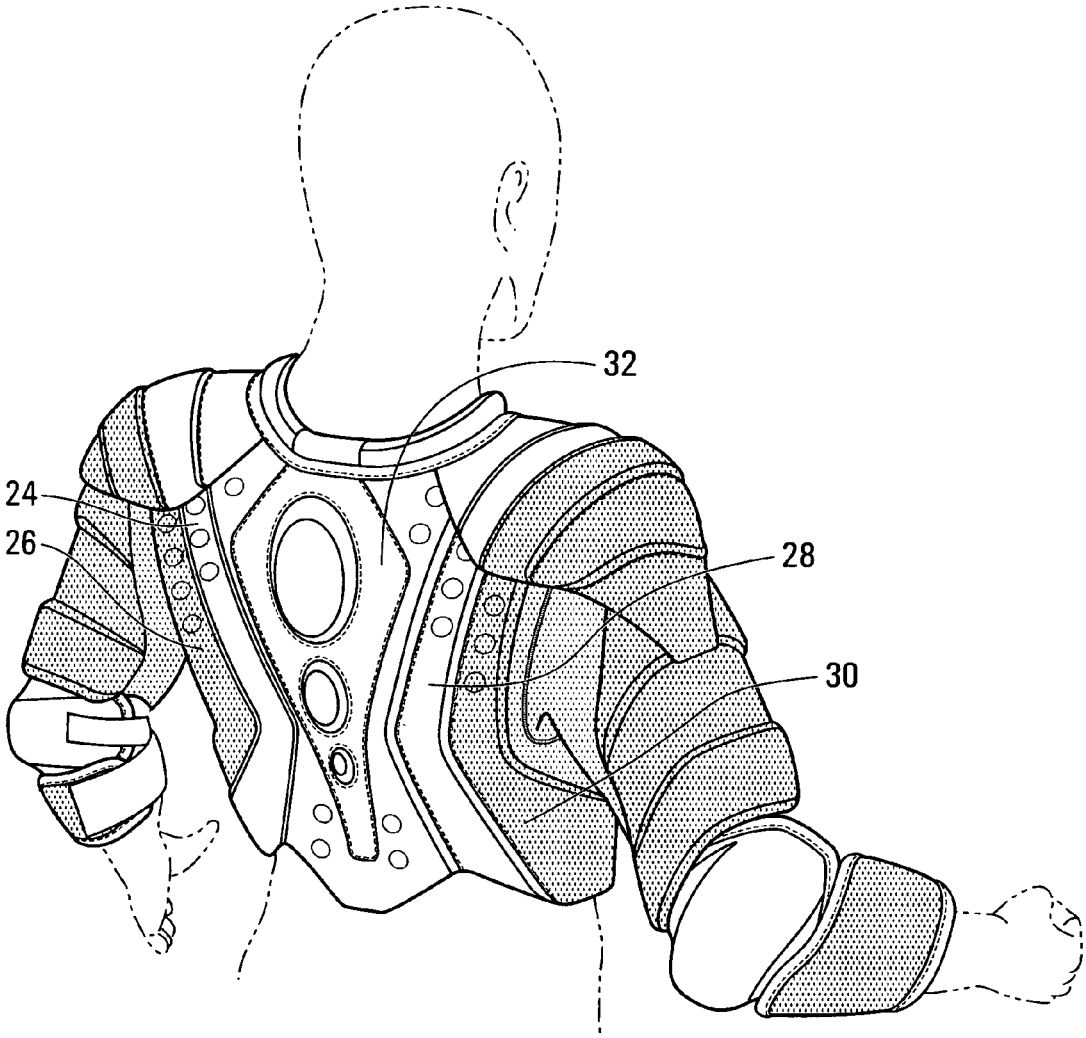
FIG. 2 is a perspective rear side view of the shoulder pads of FIG. 1.
Figure 3:
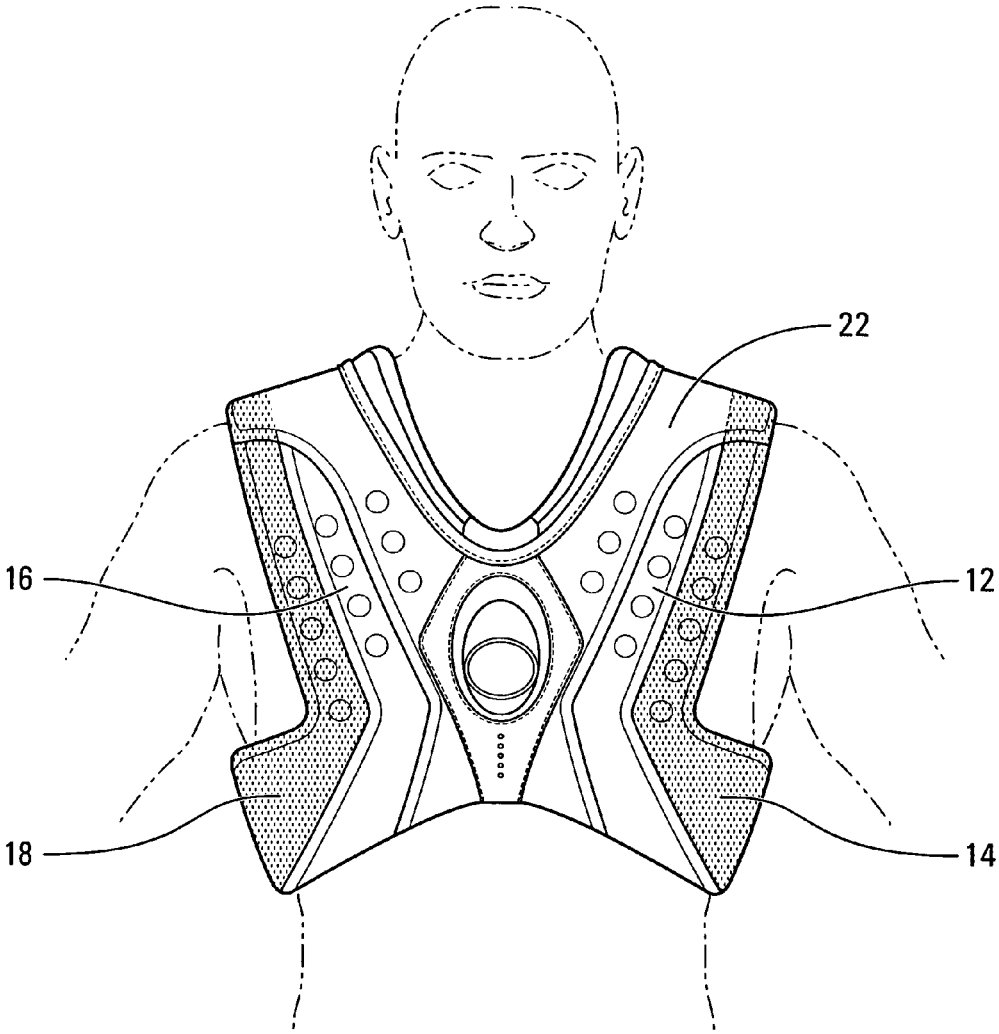
FIG. 3 is a front view showing overlapping front protective panels of the shoulder pads of FIG. 1.
Figure 4:
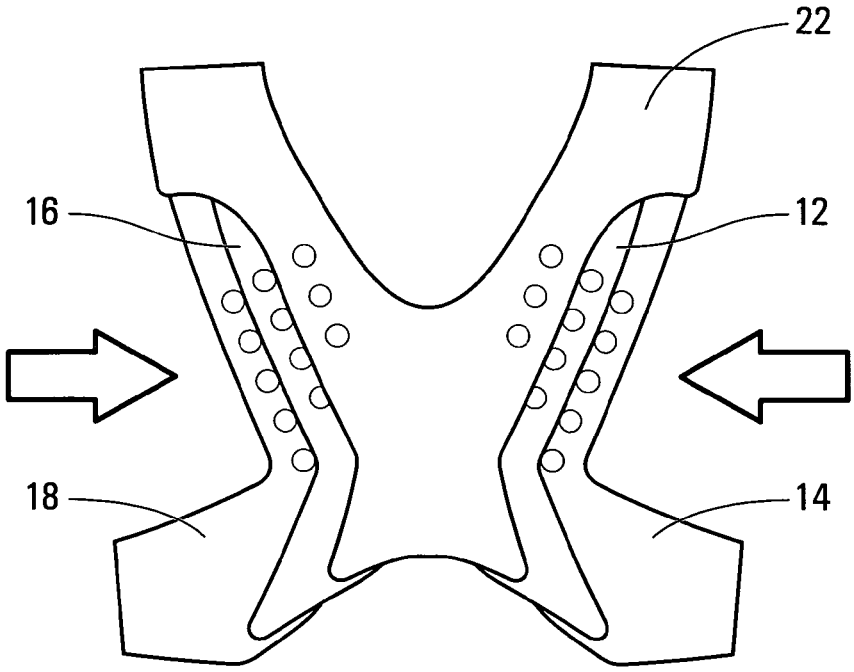
FIG. 4 is a front view showing overlapping front protective panels of the shoulder pads in a retracted position.
Figure 5:
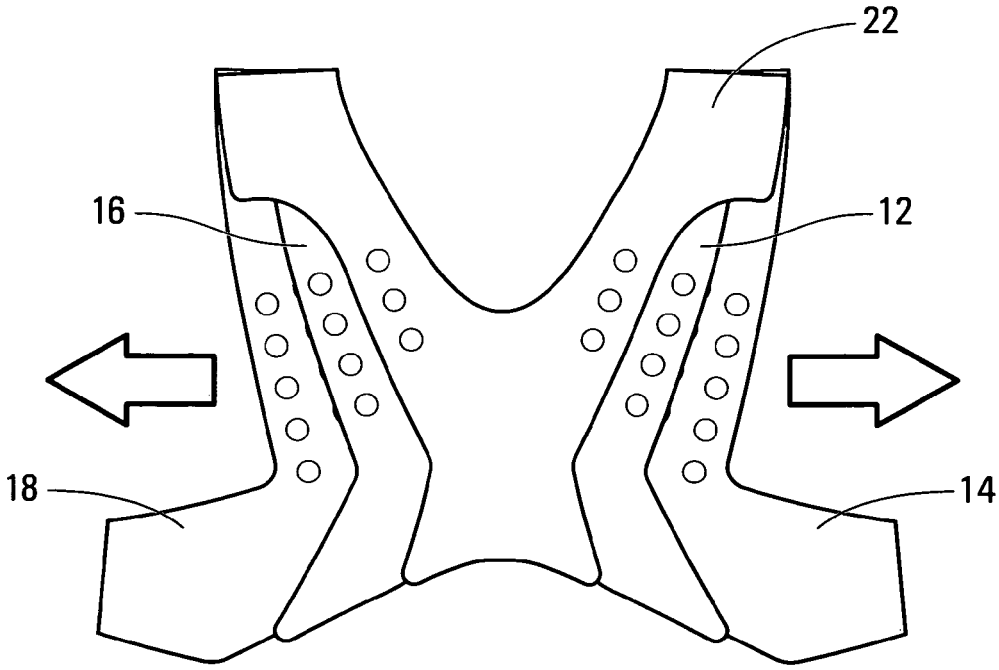
FIG. 5 is a front view showing the front panels of FIG. 4 in an extended position.
Figure 6:
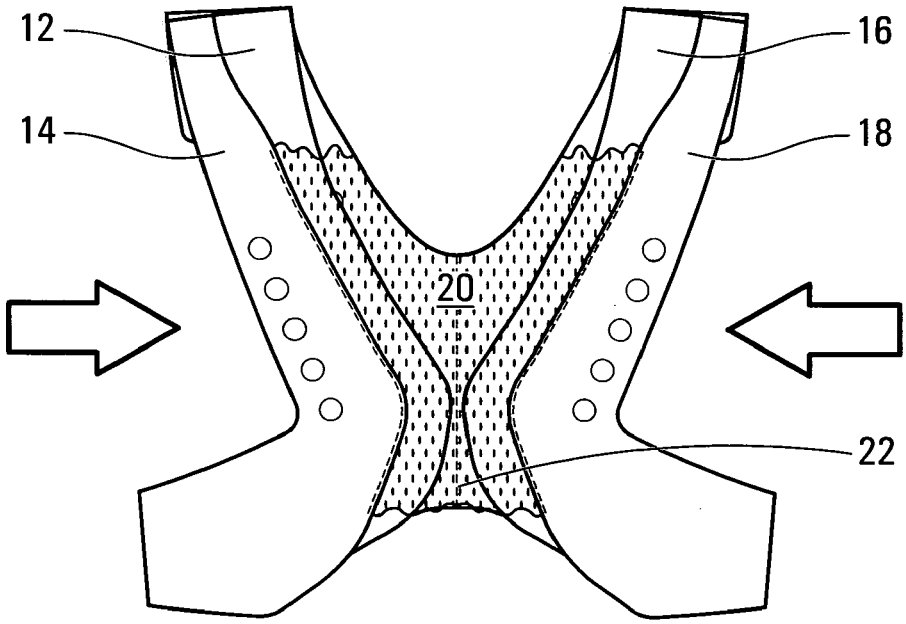
FIG. 6 is a rear view of the overlapping front panels of FIG. 4.
Figure 7:
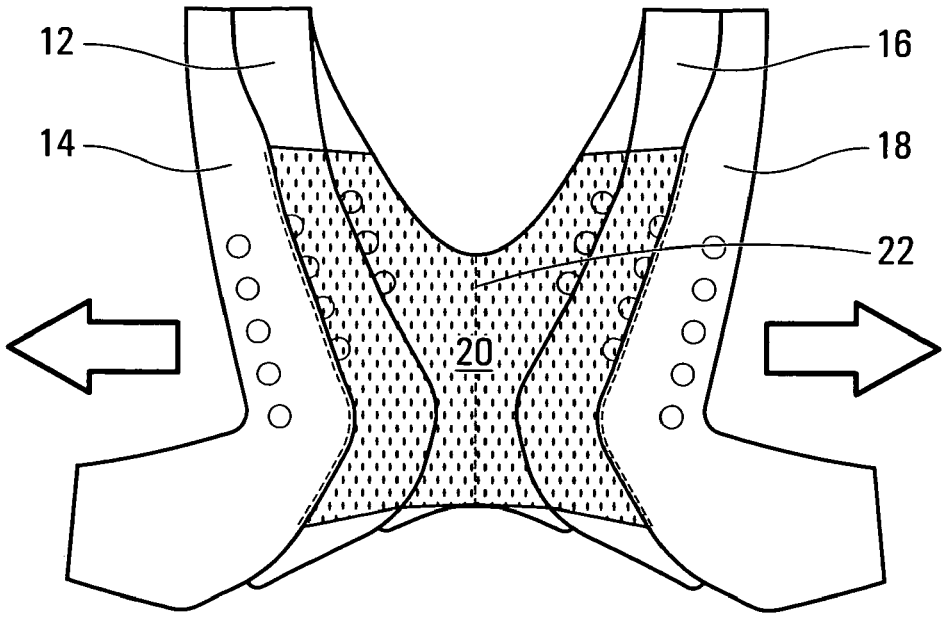
FIG. 7 is a rear view of the overlapping front panels of FIG. 5.
Figure 8:
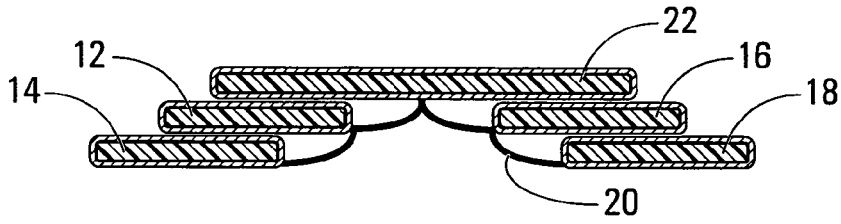
FIG. 8 is a cross sectional view of the overlapping front panels of FIG. 6.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Shown in FIGS. 1 to 9 is shoulder pads 10 constructed in accordance with an embodiment of the present invention and adapted for being worn by a sports player (hockey player, lacrosse player or football player) having a thorax with left and right front regions and left and right rear regions.

The shoulder pads 10 comprise first left front separate protective panel 12 and second left front separate protective panel 14, both for covering at least partially the left front region of the thorax. The shoulder pads 10 also comprise first right front separate protective panel 16 and second right front separate protective panel 18, both for covering at least partially the right front region of the thorax.

The first left front panel 12 at least partially overlaps the second left front panel 14 and the first right front panel 16 at least partially overlaps the second right front panel 18.

The first and second left front panels 12, 14 and first and second right front panels 16, 18 are connected together by a front elastic band 20 allowing movement of the first left and right front panels 12, 16 relative to the respective second left and right front panels 14, 18 between an extended position (see FIGS. 5, 7 and 9), wherein there is a first front overlapping between the respective first and second left front panels 12, 14 and first and second right front panels 16, 18, and a retracted position (see FIGS. 4, 6 and 8), wherein there is a second front overlapping between the respective first and second left front panels 12, 14 and first and second left front panels 16, 18, the second front overlapping being larger than the first front overlapping.

The shoulder pads 10 further comprise a central front separate protective panel 22 for covering at least partially the left and right front regions of the thorax. The front elastic band 20 connects the central front panel 22 to the first left and right front panels 12, 16.

Figure 9:
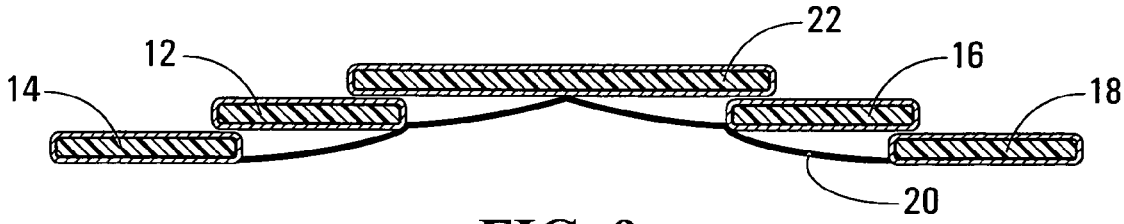
FIG. 9 is a cross sectional view of the overlapping front panels of FIG. 7.

The length of the front elastic band 20 is selected such that, in the extended position, the central front panel 22 at least partially overlaps the respective first left and right front panels 12, 16 and the first left and right front panels 12, 16 at least partially overlap the respective second left and right front panels 14, 18 as shown in FIG. 9.

The shoulder pads 10 also comprise first left rear separate protective panel 24 and second left rear separate protective panel 26, both for covering at least partially the left rear region of the thorax. The shoulder pads 10 also comprise first right rear separate protective panel 28 and second right rear separate protective panel 30, both for covering at least partially the right rear region of the thorax.

The first left rear panel 24 at least partially overlaps the second left rear panel 26 and the first right rear panel 28 at least partially overlaps the second right rear panel 30. The first and second left rear panels 24, 26 and first and second right rear panels 28, 30 are connected together by a second elastic band (now shown). As for the front elastic band 20, the second elastic band allows movement of the first left and right rear panels 24, 28 relative to the respective second left and right rear panels 26, 30 between an extended position, wherein there is a first rear overlapping between the respective first and second left rear panels 24, 26 and first and second right rear panels 28, 30, and a retracted position, wherein there is a second rear overlapping between the respective first and second left rear panels 24, 26 and first and second left rear panels 28, 30, the second rear overlapping being larger than the first rear overlapping.

The shoulder pads 10 further comprise a central rear separate protective panel 32 for covering at least partially the left and right rear regions of the thorax. The rear elastic band connects the central rear panel 32 to the first left and right rear panels 24, 28.

The length of the rear elastic is selected such that, in the extended position, the central rear panel 32 at least partially overlaps the respective first left and right rear panels 24, 28 and the first left and right rear panels 24, 28 at least partially overlap the respective second left and right rear panels 26, 30.

Each of the panels 12, 14, 16, 18, 22, 24, 26, 28, 30 and 32 may be confined in an envelope.

The panels 12, 14, 16, 18, 22, 24, 26, 28, 30 and 32 may be made of thermoformable foam or any other suitable energy absorption material while the envelope and elastic bands may be made of fabric or any other suitable elastic material. The panels 12, 14, 16, 18, 22, 24, 26, 28, 30 and 32 may also be formed from foam material covered by layers of woven synthetic yarn. They may comprise closed cell foam of ethylene vinyl acetate covered by mesh outer layers of a woven synthetic material such as polyester. External shells made of relatively stiff material may also be riveted or sewn to the panels, or similar internal shells may be inserted therein, in order to provide added protection if necessary.

The panels 12, 14, 16, 18, 22, 24, 26, 28, 30 and 32 may be stitched to a garment made of any suitable material for contacting the skin of the sports player. The panels 12, 14, 16, 18, 22, 24, 26, 28, 30 and 32 may comprises aeration apertures.

The shoulder pad 10 may comprises shoulder caps for covering the shoulder and clavicle of the sports player. These shoulder caps may be made of thermoformable foam or any other suitable energy absorption material. They may instead comprise a shoulder liner and a molded curved shoulder cap. The shoulder pad 10 may also comprise biceps pads for covering the biceps of the sports player.

The shoulder pad 10 may also comprise arm protectors, each comprising an upper arm protector for protecting the upper arm of the sports player, a lower arm protector for protecting the lower arm of the sports player, and an elbow shell between the upper arm protector and the lower arm protector for protecting the elbow of the sports player. The shoulder pads may also comprise suspending means for retaining the arm protectors to the shoulder pads.

The shoulder pads 10 may also comprise an abdominal panel for covering the abdominal region of the sports player.

The central front and rear panels 22 and 32 may be interconnected together via left and right shoulder arches. These arches and central front and rear panels may be integrally formed together to define a central unit.

The second left front panel 14 may be affixed to the second left rear panel 26 via affixing means such as zipper or VELCRO loops and hooks. Similarly, the second right front panel 18 may be affixed to the second left right panel 30 via affixing means such as zipper or VELCRO loops and hooks The above description of embodiments should not be interpreted in a limiting manner since other variations, modifications and refinements are possible within the spirit and scope of the present invention. The scope of the invention is defined by the appended claims and their equivalents.

The invention claimed is:

1. Shoulder pads for protecting a sports player having a thorax with left and right front regions and left and right rear regions, said shoulder pads comprising first and second left front separate protective panels and first and second right front separate protective panels for covering at least partially the respective left and right front regions of the thorax, said first left front panel at least partially overlapping said second left front panel and said first right front panel at least partially overlapping said second right front panel, said first and second left and right front panels being connected together by a front elastic band allowing movement of said first left and right front panels relative to said respective second left and right front panels between an extended position and a retracted position;

wherein, in said extended position, there is a first left front overlapping between said respective first and second left front panels and a first right front overlapping between said respective first and second right front panels;

wherein, in said retracted position, there is a second left front overlapping between said respective first and second left front panels and a second right front overlapping between said respective first and second right front panels;

wherein said second left front overlapping is larger than said first left front overlapping;

wherein said second right front overlapping is larger than said first right front overlapping; and wherein said shoulder pads have a central front separate protective panel for covering at least partially the left and right front regions of the thorax and wherein said front elastic band connects said central front panel to said first left and right front panels.

2. Shoulder pads in accordance to claim 1, wherein said front elastic band allows movement of said first left and right front panels relative to said central front panel between an extended position, wherein there is a first central front overlapping between said first left and right front panels and said central front panel, and a retracted position, wherein there is a second central front overlapping between said first left and right front panels and said central front panel, said second front overlapping being larger than said first front overlapping.

3. Shoulder pads in accordance to claim 2, comprising first and second left rear separate protective panels and first and second right rear separate protective panels for at least partially covering the respective left and right rear regions of the thorax, said first left rear panel at least partially overlapping said second left rear panel and said first right rear panel at least partially overlapping said second right rear panel, said first and second left and right rear panels being connected together by a rear elastic band allowing movement of said first left and right rear panels relative to said respective second left and right rear panels between an extended position and a retracted position;

wherein, in said extended position, there is a first left rear overlapping between said respective first and second left rear panels and a first right rear overlapping between said respective first and second right rear panels;

wherein, in said retracted position, there is a second left rear overlapping between said respective first and second left rear panels and a second right rear overlapping between said respective first and second right rear panels;

wherein said second left rear overlapping is larger than said first left rear overlapping; and wherein said second right rear overlapping is larger than said first right rear overlapping.

4. Shoulder pads according to claim 3, comprising a central rear separate protective panel for covering at least partially the left and right rear regions of the thorax and wherein said rear elastic band connects said central rear panel to said first left and right front panels.

5. Shoulder pads in accordance to claim 4, wherein said rear elastic band allows movement of said first left and right rear panels relative to said central rear panel between an extended position, wherein there is a first central rear overlapping between said first left and right rear panels and said central rear panel, and a retracted position, wherein there is a second central rear overlapping between said first left and right rear panels and said central panel, said second central rear overlapping being larger than said first central rear overlapping.

6. Shoulder pads for protecting a sports player having a thorax with left and right front regions and left and right rear regions, said shoulder pads comprising first and second left rear separate protective panels and first and second right rear separate protective panels for covering at least partially the respective left and right rear regions of the thorax, said first left rear panel at least partially overlapping said second left rear panel and said first right rear panel at least partially overlapping said second right rear panel, said first and second left and right rear panels being connected together by a rear elastic band allowing movement of said first left and right rear panels relative to said respective second left and right rear panels between an extended position and a retracted position;

wherein, in said extended position, there is a first left rear overlapping between said respective first and second left rear panels and a first right rear overlapping between said respective first and second right rear panels;

wherein, in said retracted position, there is a second left rear overlapping between said respective first and second left rear panels and a second right rear overlapping between said respective first and second right rear panels;

wherein said second left rear overlapping is larger than said first left rear overlapping;

wherein said second right rear overlapping is larger than said first right rear overlapping; and wherein said shoulder pads have a central rear separate protective panel for covering at least partially the left and right rear regions of the thorax and wherein said rear elastic band connects said central rear panel to said first left and right rear panels.

7. Shoulder pads in accordance to claim 6, wherein said rear elastic band allows movement of said first left and right rear panels relative to said central rear panel between an extended position, wherein there is a first central rear overlapping between said first left and right rear panels and said central rear panel, and a retracted position, wherein there is a second central rear overlapping between said first left and right rear panels and said central rear panel, said second rear overlapping being larger than said first rear overlapping.

8. Shoulder pads in accordance to claim 7, comprising first and second left front separate protective panels and first and second right front separate protective panels for at least partially covering the respective left and right front regions of the thorax, said first left front panel at least partially overlapping said second left front panel and said first right front panel at least partially overlapping said second right front panel, said first and second left and right front panels being connected together by a front elastic band allowing movement of said first left and right front panels relative to said respective second left and right front panels between an extended position and a retracted position;

wherein, in said extended position, there is a first left front overlapping between said respective first and second left front panels and a first right front overlapping between said respective first and second right front panels;

wherein, in said retracted position, there is a second left front overlapping between said respective first and second left front panels and a second right front overlapping between said respective first and second right front panels;

wherein said second left front overlapping is larger than said first left front overlapping; and wherein said second right front overlapping is larger than said first right front overlapping.

9. Shoulder pads according to claim 8, comprising a central front separate protective panel for covering at least partially the left and right front regions of the thorax and wherein said front elastic band connects said central front panel to said first left and right front panels.

10. Shoulder pads in accordance to claim 9, wherein said front elastic band allows movement of said first left and right front panels relative to said central front panel between an extended position, wherein there is a first central front overlapping between said first left and right front panels and said central front panel, and a retracted position, wherein there is a second central front overlapping between said first left and right front panels and said central panel, said second central front overlapping being larger than said first central front overlapping.

11. Shoulder pads for protecting a hockey player having a thorax with left and right front regions and left and right rear regions, said shoulder pads comprising:

(a) first and second left front separate protective panels and first and second right front separate protective panels for covering at least partially the respective left and right front regions of the thorax, said first left front panel at least partially overlapping said second left front panel and said first right front panel at least partially overlapping said second right front panel, said first and second left and right front panels being connected together by a front elastic band allowing movement of said first left and right front panels relative to said respective second left and right front panels between an extended position and a retracted position;

wherein, in said extended position, there is a first left front overlapping between said respective first and second left front panels and a first right front overlapping between said respective first and second right front panels;

wherein, in said retracted position, there is a second left front overlapping between said respective first and second left front panels and a second right front overlapping between said respective first and second right front panels;

wherein said second left front overlapping is larger than said first left front overlapping; and wherein said second right front overlapping is larger than said first right front overlapping;

(b) first and second left rear separate protective panels and first and second right rear separate protective panels for at least partially covering the respective left and right rear regions of the thorax, said first left rear panel at least partially overlapping said second left rear panel and said first right rear panel at least partially overlapping said second right rear panel, said first and second left and right rear panels being connected together by a rear elastic band allowing movement of said first left and right rear panels relative to said respective second left and right rear panels between an extended position and a retracted position;

wherein, in said extended position, there is a first left rear overlapping between said respective first and second left rear panels and a first right rear overlapping between said respective first and second right rear panels;

wherein, in said retracted position, there is a second left rear overlapping between said respective first and second left rear panels and a second right rear overlapping between said respective first and second right rear panels;

wherein said second left rear overlapping is larger than said first left rear overlapping; and wherein said second right rear overlapping is larger than said first right rear overlapping; and (c) a central front separate protective panel for covering at least partially the left and right front regions of the thorax and wherein said front elastic band connects said central front panel to said first left and right front panels.

12. Shoulder pads according to claim 11, comprising a central rear separate protective panel for covering at least partially the left and right rear regions of the thorax and wherein said rear elastic band connects said central rear panel to said first left and right rear panels.

13. Shoulder pads in accordance to claim 12, wherein said rear elastic band allows movement of said first left and right rear panels relative to said central rear panel between an extended position, wherein there is a first central rear overlapping between said first left and right rear panels and said central rear panel, and a retracted position, wherein there is a second central rear overlapping between said first left and right rear panels and said central rear panel, said second rear overlapping being larger than said first rear overlapping.

14. Shoulder pads in accordance to claim 11, wherein said front elastic band allows movement of said first left and right front panels relative to said central front panel between an extended position, wherein there is a first central front overlapping between said first left and right front panels and said central front panel, and a retracted position, wherein there is a second central front overlapping between said first left and right front panels and said central panel, said second central front overlapping being larger than said first central front overlapping.

* * * * *

UNITED STATES PATENT AND TRADEMARK OFFICE

CERTIFICATE OF CORRECTION

PATENT NO. : 7,647,651 B2
APPLICATION NO. : 11/506875
DATED : January 19, 2010
INVENTOR(S) : Contant et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 563 days.

Signed and Sealed this

Sixteenth Day of November, 2010

David J. Kappos

David J. Kappos
*Director of the United States Patent and Trademark Office*